US006334804B1

(12) United States Patent
Brown

(10) Patent No.: US 6,334,804 B1
(45) Date of Patent: Jan. 1, 2002

(54) TOY BALLOON OR GAME BALL

(75) Inventor: Michael Carr Brown, Bristol (GB)

(73) Assignee: Michael C. Brown, Bristol (GB)

( * ) Notice: Subject to any disclaimer, the term of this patent is extended or adjusted under 35 U.S.C. 154(b) by 0 days.

(21) Appl. No.: 09/235,194

(22) Filed: Jan. 22, 1999

(30) Foreign Application Priority Data

Jan. 24, 1998 (GB) ..... 9801452

(51) Int. Cl.[7] ..... A63H 27/10
(52) U.S. Cl. ..... 446/220; 473/610
(58) Field of Search ..... 446/220, 221, 446/223, 225, 226; 473/604, 609, 610, 611

(56) References Cited

U.S. PATENT DOCUMENTS 1,702,732 A * 2/1929 Iden ..... 473/610
2,041,737 A * 5/1936 Beal ..... 446/220
3,755,820 A * 9/1973 Petrusek ..... 473/610
4,015,111 A * 3/1977 Spector ..... 446/220
4,213,267 A * 7/1980 Curtis
4,463,513 A * 8/1984 Wallace
4,470,218 A * 9/1984 Yu ..... 446/220
5,254,026 A * 10/1993 Kaiser ..... 446/220
6,019,660 A * 2/2000 Luciano ..... 446/220

FOREIGN PATENT DOCUMENTS

GB 631202 * 10/1949

* cited by examiner

*Primary Examiner*—John A. Ricci

(57) ABSTRACT

A NOVEL TOY BALLOON OR BAME BALL comprises a rubber balloon with a tube like structure that projects from the containing wall of the balloon opposite the neck. When this tube projects into the body of the balloon, the end of it can be held to one side of the mouthpiece during inflation then tied together with the neck to seal the balloon. The resultant balloon has a hollow core open at one end and is approximately spherical. This novel elastic structure has a multitude of uses some of which are in different fields. One particular use is that it provides a new type of rubber game ball.

3 Claims, 2 Drawing Sheets

TOY BALLOON OR GAME BALL

BACKGROUND OF THE INVENTION

The "cheap and cheerful", rubber, toy or party balloon is a familiar object first introduced to the world about 100 years ago. Over the years the standard, rounded balloon has been modified usually in order to make it more attractive or saleable. Hence; different shapes and sizes, a greater range of colours, improved balloon imprinting techniques, inflation with helium and so on. The present invention introduces a new type of balloon into this context. As well as being a new type of toy balloon, the novel balloon functions as a novel entity in diverse fields. It is spherical, bouncy and has a non erratic trajectory which can be controlled by skill so that it also constitutes a new type of rubber game ball. An uninflated balloon is, in essence, very similar to a condom but the way in which the two are used is very different. Both are elastic containers which can be fluid filled. The novel balloon is a pioneering invention, and when configured in an appropriate way, it can be useful as a sex aid, a medical tool, in robotics and so on.

BRIEF SUMMARY OF THE INVENTION

The novel balloon has a long, thin tubule that is integral with and projects from a position on the main body of the balloon opposite the neck. The balloon is made on a former with a projection which aligns with an axis that also passes through the neck. Stripped from the former, the tubule can project externally from the main body or internally into the main body of the balloon. (See FIGS. 3 and 4.) When a tubule projects into the body of the balloon and is of a length such that it can be held, pinched between first finger and thumb at the mouthpiece, the balloon can be inflated then sealed by tying the neck together with the end of the tubule (See FIG. 2).

The stretched tubule within the inflated and specially tied balloon pulls the neck and mouthpiece into the body of the balloon and the resultant balloon is substantially spherical with a hollow core that is open at one end.

DETAILED DESCRIPTION OF THE INVENTION

Figure 1:
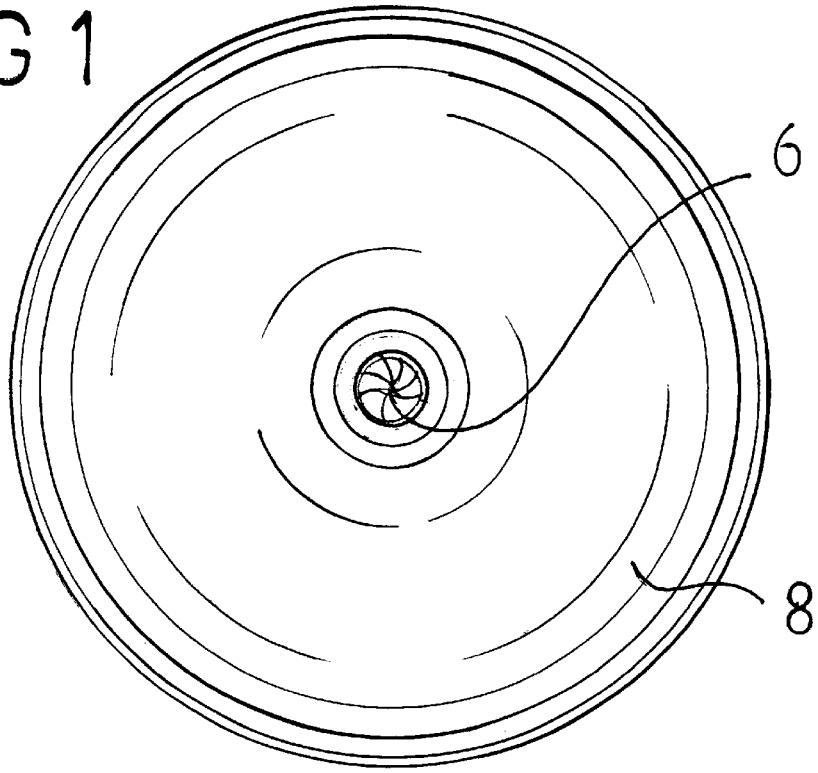
FIG. 1 is a perspective view of the novel balloon when inflated.

A novel balloon, herein described, is an inflatable latex rubber envelope comprising a relatively wide balloon envelope, an aperture provided in the balloon envelope for inflating the balloon (the neck and mouthpiece) and a relatively narrow protrusion, herein referred to as a tubule or 'tube like projection', extending from the balloon envelope at a point thereof spaced from the inflation aperture, the length of the protrusion being sufficient to enable it to be extended internally through the balloon envelope to be secured to the balloon envelope at the neck when the same is inflated. The protrusion is hollow and preferably extends from the balloon envelope along an axis of symmetry of the balloon which also passes through the inflation aperture. The balloon envelope is most preferably substantially spherical.

A novel balloon herein described is moulded on a novel type of former. The former comprises a relatively wide portion that is usually substantially spherical and which defines the shape of the balloon envelope or main body of the balloon, a formation defining the desired shape for the neck and position of the inflation aperture (mouthpiece), and a relatively long and narrow protrusion projecting from the main body of the balloon, opposite to and on the same axis as the neck, which defines the shape and position of the "tube like projection" of the novel balloon.

Generally, rubber balloons are manufactured by dipping clean formers made of porcelain or plastic and mounted on bars into a tank of latex coagulating solution, withdrawing them, then dipping them into a tank of rubber latex. They are withdrawn from the rubber latex, partially dried, then a bead is formed at the mouthpiece by rolling back the top part of the neck using a rotating brush arrangement. The balloons on their formers are then kiln dried and cured before being stripped from their formers, a bar at a time, by a machine that grips the balloons on their formers between two large rubber pads then pulls the balloons down (or up) and off their formers. The balloons are then washed, dried and packed.

A novel former has a configuration such that when a balloon is stripped from it during the type of manufacturing process outlined above, the tubule part of the balloon that has been formed on the "tube like projection" generally becomes internalised within the main body of the balloon. This is a distinguishing feature of the novel balloon. (A novel balloon can also be hand or otherwise stripped from its former so that the tube like projection is not internalised within the balloon but projects externally from the main body or envelope of the balloon.)

A novel balloon of the invention, can be inflated and sealed in a variety of ways. There is a particular way of inflating and sealing the balloon which is not obvious and which the relative sizes of the tubule, the body and the neck are designed to enable. When the length of the tubule is approximately the same as the distance between the bead at the mouthpiece and the base of the balloon envelope (See FIG. 4), the end of the tubule can be held, pinched between finger and thumb, to one side of the mouthpiece while the balloon is inflated and then can be tied together with the neck when sealing the balloon.

The novel ball when inflated and tied in the special way described in the last paragraph is approximately spherical and has a hollow core which is open at one end. The hollow core is made up of the tubule stretching through the interior of the balloon with its tip tied together with the neck. The balloon, being spherical with the neck and mouthpiece pulled into the body of the balloon by the tubule, has a non-erratic trajectory and is great fun to play with. It is a new type of game ball and has been described as a "Balloon Ball" or a lightweight rubber ball.

A novel balloon with the tube like projection internalised can be turned outside in so that the tube like projection projects externally, conversely, a novel balloon with its tube like projection projecting externally can be turned outside in so that the tube like projection projects internally. The way of telling if the balloon as a whole is the right side out or outside in is to look at the bead which forms the mouthpiece, it is outside the balloon when the balloon is right side out i.e. as it looks when on the former (See FIG. 3).

A novel balloon joins, in effect, a normal rounded balloon with a long thin modelling type of balloon. The length of the tubule is generally such that it is approximately the same as the distance from the base of its projection to the mouthpiece of an uninflated balloon or a bit more than the diameter of the main body of the balloon (see FIG. 4). This facilitates the special inflation and sealing process because the end of the tubule naturally positions itself level with the mouthpiece as well as helping optimise the spherical nature of the balloon. However for certain applications the tubule may be a bit longer or shorter but not shorter than the diameter of the main body of the balloon. Also, the tubule's diameter may vary along its length so that, for instance, a section from the base to about halfway along the length is different from the remaining length of the tubule.

Distinguishing Features

A novel balloon of the invention must be distinguished from a certain type of modelling balloon some times called a 'B body' balloon. This type of balloon is much smaller and generally narrower than a novel balloon, however it can be used to produce an apple type of shape which is similar to the novel balloon in that a part of the balloon straddles the interior and is attached to the knot, pulling the knot into the body of the balloon. Apart from the considerable size and shape differences between the two types of balloon the useful purpose of the two types of balloon is quite distinct. Furthermore, in the "B body" balloon the knot and projecting bit are joined, after the balloon has been inflated and sealed, by twisting them together whereas in a novel balloon they are attached together during the inflation and sealing process.

Applications

A novel balloon of the invention has characteristics that can be appreciated and utilised in its capacity as a toy, modelling or decorative balloon. A novel balloon may be used by balloon sculptors or entertainers together with other modelling balloons in a great variety of ways. A novel balloon may be used to various effects by balloon decorators, for instance a glow in the dark chemical light stick can be inserted into the hollow core of a clear balloon to make a "balloon light" or a rod can be pushed into the hollow core to achieve a variety of useful effects and so on. A novel balloon also has applications in other fields.

Of particular interest and therefore noted in the title of the invention is that a novel balloon can be used as a game ball. Game balls are often, in some way, made of rubber; the golf ball, squash ball, volley ball, tennis ball and so on. The new balloon is a new kind of light weight rubber ball with its own special characteristics. It is approximately spherical, like an orange, and doesn't have a tied neck projecting from the balloon surface like a normal rubber balloon, instead the neck and mouthpiece are pulled into the body of the balloon. It has a non-erratic trajectory and can be struck with skill to achieve various controlling effects. It is particularly suited for indoor play where its light weight means that it does not easily knock things over. One can devise games like squash and volleyball, the ball can be hit softly or very hard as well as being spun by hitting the ball in a particular way. The new ball which is generally about 12"–14" in diameter, approximately a bit bigger than a basket ball or a football (soccer ball), is great for helping develop ball skills and hand or foot to eye co-ordination because it can travel much more slowly than a normal (heavier) ball. The new ball is also a useful adjunct to exercising, just hitting it against a wall using hands, feet, head or body is an absorbing activity and is not repetitive in that the ball never bounces back off the wall in quite the same way.

A novel balloon of the invention has applications as a sex aid. Balloons are generally gas filled but they can also be filled with water. A novel balloon can be filled with water to varying degrees and the end of the tubule tied together with the neck using the same technique as described earlier for gas filled balloons. A novel balloon filled with a liquid or gas can be inflated to the size of a female breast then held in place by a bra or bodice to simulate the same. Furthermore a novel balloon can be inflated as just described but to a bigger size and used as an artificial vagina.

Balloons of the invention, but with a very long tubule bit or of a particularly small size etc., may be of use in surgical or medical fields.

Balloons of the invention may be of use in mechanical handling or robotics particularly when certain shaped objects have to be moved. The balloon can be configured so that it is attached to a moveable jig, and if the end of the tubule is cut off and a solid tube inserted into it and the neck tied around them both after the balloon is inflated, the balloon can then be pushed onto an object and a vacuum applied through the tube inside the tubule so that the object is held and can be moved. Also novel balloons with their neck tied can be inflated through the tubule if its end is cut off; novel balloons can be positioned inside another balloon with its neck open and the ends of the tubules projecting out of the mouthpiece and the different balloons variously inflated and deflated to achieve various effects.

Figure 3:
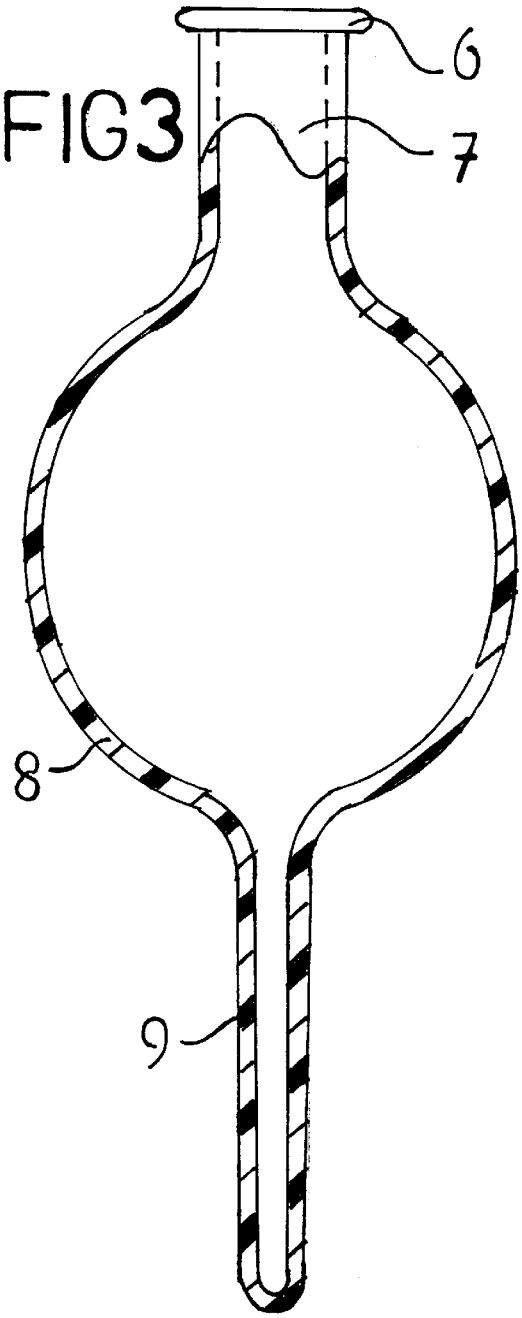
FIG. 3 shows a central, vertical section through an uninflated balloon with the tubule-9-extending out of the main body-8.

FIG. 3 shows the central, vertical section through a rubber balloon made on a former (but which has been hand stripped from the former so that the tubule projects externally from the main body of the balloon). It comprises 6—the mouthpiece and 7—the neck, which together comprise the inflation aperture. 8—is the containing wall or main body of the balloon and 9—is the tubule or tube like projection.

Figure 4:
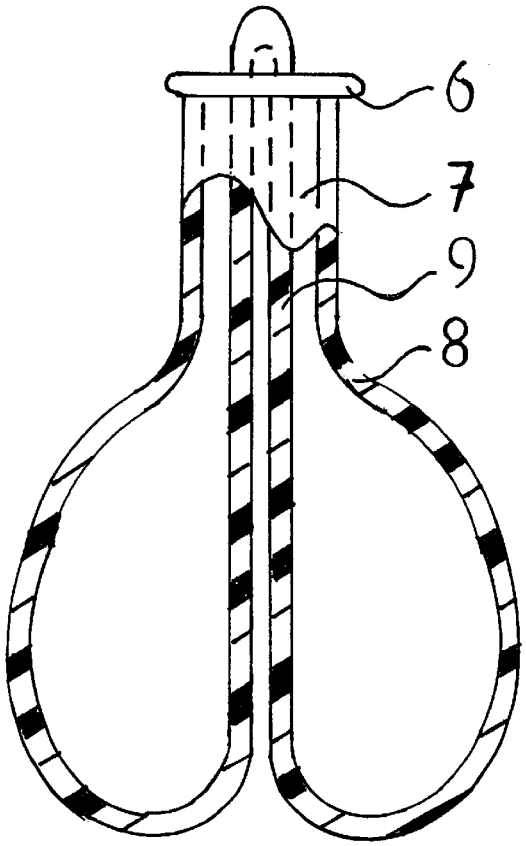
FIG. 4 shows a central, vertical section through an uninflated balloon with the tubule-9-extending into the main body-8-of the balloon, 7-is the neck and -6- the inflation opening.

FIG. 4 shows a balloon made on a former and in which the tube like projection has become internalised, this is the way that the novel balloon usually strips from its former in the automated production process described earlier. When the balloon is uninflated the length of the tube like projection approximates to the distance between its base and the mouthpiece of the balloon. This figure comprises; 6—the bead or mouthpiece, 7—the neck, 8—the main body or containing wall of the balloon and 9—the tubule or tube like projection.

Figure 2:
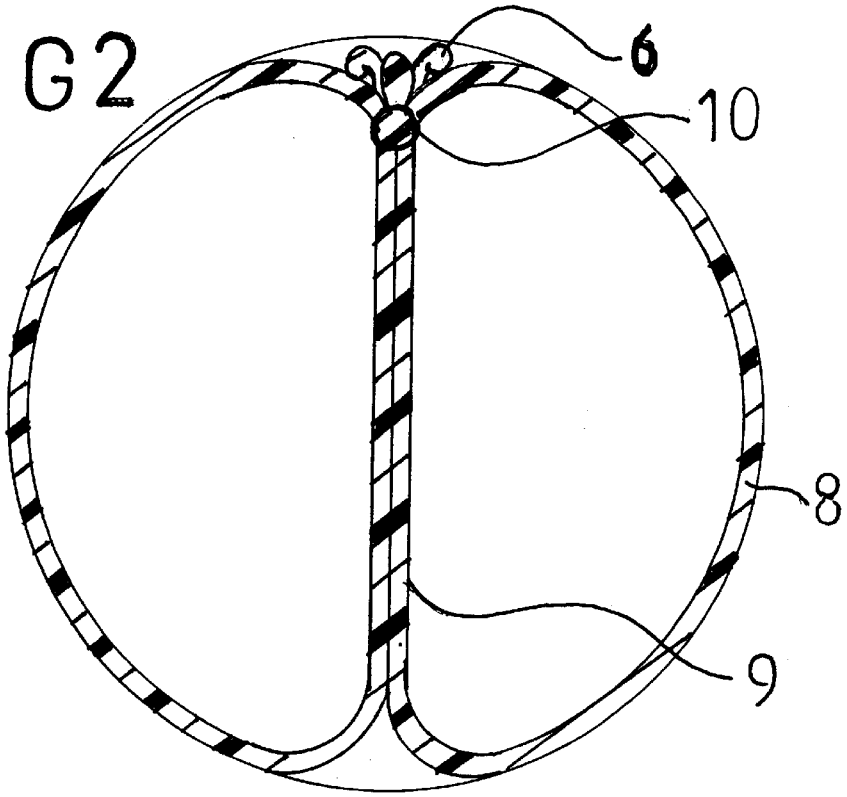
FIG. 2 shows a central section of the balloon at right angles to the view shown in FIG. 1, 8-is the containing wall of the main body of the inflated balloon, 10-the knot used to tie together the end of the tubule and the neck 9- is the tubule or tube like extension and 6-the inflation opening or mouthpiece of the balloon.

FIG. 2 shows a central section through a novel balloon that has been inflated in the special way described elsewhere. You can see 8—the containing wall of the main body of the balloon, 9—the tubule or tube like projection extending internally through the main body of the balloon and secured to the inflation aperture (neck and mouthpiece) in a way that also seals the balloon. 10—shows a knot that ties together the end of the tubule and the neck at the same time sealing the balloon. The end of the tubule can also be pulled out of the mouthpiece of the balloon then tied round the neck to seal the balloon. FIG. 2 also shows how the tubule, tied to the inflation aperture, serves to pull the neck and mouthpiece back into the main body of the balloon. A novel balloon, inflated and sealed in this way, In a novel balloon, inflated as described earlier, the tube like projection to the neck pulls the neck and mouthpiece into the body of the balloon and also opposes the tendency towards an egg shape which is caused by the expansion of the lower part of the neck on inflation.

What is claimed is:

1. A balloon comprising a main inflatable body of rubber or elastic material with an uninflated diameter; a neck having an inflation opening; and a tubule formed integral with the main body opposite the neck, the tubule extending into the main body of the balloon and being generally of a length at least as great as the uninflated diameter of the main body.

2. A balloon as in claim 1 in which the tubule is of such a length that its inner end may be attached to the neck of an inflated balloon without constraining the full inflation of the main body yet serving to pull the neck and inflation opening into the main body of the balloon so that the resulting inflated balloon is approximately spherical in shape.

3. A balloon as in claim 2, in which the neck and tubule inner end are connected by means of a knot, and tension on the tubule tends to pull the knot inward from the outer diameter of the inflated balloon, resulting in a spherical balloon with no surface projection, which is suitable for use as a game ball.

* * * * *